US012691486B2

(12) United States Patent
Chartrand et al.

(10) Patent No.: US 12,691,486 B2
(45) Date of Patent: Jul. 28, 2026

(54) COMPRESSIVE STRESS FORMING SYSTEMS AND METHODS

(71) Applicant: MAGNA INTERNATIONAL INC., Ontario (CA)

(72) Inventors: Thomas Chartrand, Oxford, MI (US); Michael Bluemel, Flatz (AU); Peter Doczy, Eisenstadt (AU)

(73) Assignee: MAGNA INTERNATIONAL INC., Aurora (CA)

( * ) Notice: Subject to any disclaimer, the term of this patent is extended or adjusted under 35 U.S.C. 154(b) by 224 days.

(21) Appl. No.: 18/699,336

(22) PCT Filed: Oct. 19, 2022

(86) PCT No.: PCT/US2022/047149

§ 371 (c)(1),
(2) Date: Apr. 8, 2024

(87) PCT Pub. No.: WO2023/069532

PCT Pub. Date: Apr. 27, 2023

(65) Prior Publication Data

US 2024/0399437 A1 Dec. 5, 2024

Related U.S. Application Data

(60) Provisional application No. 63/270,381, filed on Oct. 21, 2021.

(51) Int. Cl.
*B21D 11/08* (2006.01)
*B21D 13/02* (2006.01)
(Continued)

(52) U.S. Cl.
CPC ..... *B21D 11/08* (2013.01); *B21D 13/02* (2013.01)

(58) Field of Classification Search
CPC ..... B21D 11/08; B21D 13/02; B21D 22/02; B21D 22/20; B21D 22/21; G06F 2113/24;
(Continued)

(56) References Cited

U.S. PATENT DOCUMENTS 8,560,103 B2 * 10/2013 Kubli ..... B21D 22/20 700/145
10,150,152 B2 * 12/2018 Hirata ..... B21K 23/00
(Continued)

OTHER PUBLICATIONS

International Preliminary Report on Patentability issued in corresponding International Application No. PCT/US2022/047149 dated May 2, 2024.
(Continued)

*Primary Examiner* — Mohammed S. Alawadi
(74) *Attorney, Agent, or Firm* — Pillsbury Winthrop Shaw Pittman, LLP

(57) ABSTRACT

The present disclosure relates to forming a metallic part to decrease residual stress and reduce springback behavior in the metallic part after forming. Target locations in the metallic part for excess material are determined based on electronic modelling prior to forming. The excess material in the target locations is configured to decrease residual stress in the metallic part after forming. The metallic part is contacted for forming at one or more contact locations away from as-cut end surfaces of the metallic part, such that the as-cut end surfaces are unconstrained during forming. The excess material is caused, based on the one or more contact locations and the excess material at the one or more target locations, to flow in one or more specific directions during forming to decrease the residual stress in the metallic part and reduce springback behavior in the metallic part after forming.

20 Claims, 11 Drawing Sheets

(51) Int. Cl.

| | |
|---|---|
| ***B21D 22/02*** | (2006.01) |
| ***B21D 22/20*** | (2006.01) |
| ***B21D 22/21*** | (2006.01) |
| ***G05B 19/4093*** | (2006.01) |
| ***G06F 30/23*** | (2020.01) |
| ***G06F 113/24*** | (2020.01) |

(58) Field of Classification Search
CPC ..... G06F 30/23; G05B 19/4093; G05B 2219/45234
See application file for complete search history.

(56) References Cited

U.S. PATENT DOCUMENTS

| | | | | |
|---|---|---|---|---|
| 2006/0287755 | A1 | 12/2006 | Kubli et al. | |
| 2009/0272171 | A1 | 11/2009 | Golovashchenko | |
| 2012/0123579 | A1 | 5/2012 | Kubli et al. | |
| 2012/0283861 | A1* | 11/2012 | Zwickl ..... | G05B 19/404 700/97 |
| 2018/0154416 | A1 | 6/2018 | Hirata | |
| 2020/0360981 | A1* | 11/2020 | Kariyazaki ..... | B21D 22/26 |

OTHER PUBLICATIONS

International Search Report and Written Opinion issued in the corresponding International Application No. PCT/US2022/047149, dated Jan. 9, 2023.

* cited by examiner

COMPRESSIVE STRESS FORMING SYSTEMS AND METHODS

CROSS REFERENCE TO RELATED APPLICATION

This application claims priority to U.S. Provisional Application No. 63/270,381 filed Oct. 21, 2021, which is hereby incorporated herein in its entirety by reference.

BACKGROUND OF THE INVENTION

Field of the Invention

The present disclosure relates to systems and methods for forming metallic parts.

Description of Related Art

Processes for forming metallic parts are known. Many of these processes produce metallic parts that change shape after processing. This shape change is commonly referred to as "springback", and can be caused by residual stress that remains in a metallic part after processing, for example.

SUMMARY OF EMBODIMENTS OF THE INVENTION

The following is a non-exhaustive listing of some aspects of the present techniques. These and other aspects are described in the following disclosure.

One aspect of the present disclosure relates to a method for forming a metallic part. The method comprises determining, based on electronic modelling prior to forming, one or more target locations in the metallic part for excess material. The excess material in the target locations is configured to decrease residual stress in the metallic part after forming. The method comprises contacting the metallic part for forming at one or more contact locations away from as-cut end surfaces of the metallic part, such that the as-cut end surfaces are unconstrained during forming. The method comprises causing, based on the one or more contact locations and the excess material at the one or more target locations, the excess material to flow in one or more specific directions during forming to decrease the residual stress in the metallic part and reduce springback behavior in the metallic part after forming.

In some embodiments, the excess material comprises a bulging arcuate portion of the metallic part, and/or excess length of line, that would not normally have been provided for forming the metallic part.

In some embodiments, the one or more target locations comprise a bend between a base and a sidewall of the metallic part.

In some embodiments, causing the excess material to flow in one or more specific directions during forming produces: (1) a pattern of plastic compression in the sidewall, elastic compression in the bend, and plastic tension in the base, on an outside radius of the bend; and (2) a corresponding pattern of plastic tension in the sidewall, elastic tension in the bend, and plastic compression in the base, on an inside radius of the bend; to decrease the residual stress in the metallic part and reduce springback behavior in the metallic part after forming.

In some embodiments, causing the excess material to flow in one or more specific directions during forming produces balanced opposite bending moments on either side of the bend to decrease the residual stress in the metallic part and reduce springback behavior in the metallic part after forming.

In some embodiments, the method further comprises pre-forming the metallic part so it includes the excess material at the one or more target locations.

In some embodiments, the metallic part comprises a floor pan, battery tray, or a U model beam.

In some embodiments, the electronic modelling comprises predicting stresses in the metallic part caused by forming, using finite element analysis (FEA).

In some embodiments, the predicted stresses comprise tensile stresses caused by material deformation, and compressive stresses in local areas of the metallic part induced by the excess material.

In some embodiments, the one or more target locations comprise a bend between a base and a sidewall of the metallic part, and contacting comprises holding and/or compressing the metallic part between two opposing surfaces of a die that span the bend from the base to the sidewall.

Another aspect of the present disclosure relates to a system for forming a metallic part. The system comprise one or more processors configured to determine, based on electronic modelling prior to forming, one or more target locations in the metallic part for excess material. The excess material in the target locations is configured to decrease residual stress in the metallic part after forming. The system comprises a forming tool. The forming tool comprises one or more contacts configured to contact the metallic part for forming at one or more contact locations away from as-cut end surfaces of the metallic part, such that the as-cut end surfaces are unconstrained during forming. The forming tool further comprises one or more dies configured to cause, based on the one or more contact locations and the excess material at the one or more target locations, the excess material to flow in one or more specific directions during forming to decrease the residual stress in the metallic part and reduce springback behavior in the metallic part after forming.

These and other aspects of various embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

All closed-ended (e.g., between A and B) and open-ended (greater than C) ranges of values disclosed herein explicitly include all ranges that fall within or nest within such ranges. For example, a disclosed range of 1-10 is understood as also disclosing, among other ranged, 2-10, 1-9, 3-9, etc.

BRIEF DESCRIPTION OF THE DRAWINGS

For a better understanding of embodiments of the present invention as well as other objects and further features thereof, reference is made to the following description which is to be used in conjunction with the accompanying drawings, where.

DETAILED DESCRIPTION OF EXEMPLARY EMBODIMENTS OF THE INVENTION

As described above, many forming processes produce metallic parts (e.g., sheet metal parts and/or other parts) that change shape, or exhibit "springback," after processing. Springback can be caused by residual stress that remains in a metallic part after processing, for example. Springback is detrimental because it can cause a part to be dimensionally unstable. Springback can change the dimensions of a metallic part so that the part no longer fits within a specification (e.g., reducing a process yield), or no longer functions for its intended purpose. Springback can force adjustments in other components that are coupled to the metallic part, force process parameter changes, and increase manufacturing tooling costs. For example, springback can increase costs associated with quality control loops (e.g., a repeating process of producing a part, evaluating the part, and adjusting the processing to ensure the part meets a specification). Springback can also reduce customer confidence in a manufacturer, and/or even cause the manufacturing to lose the business of the customer, and/or have other effects.

Advantageously, the present systems and methods decrease residual stress in metallic parts and reduce springback behavior in metallic parts after forming. In contrast to prior systems and methods, one or more target locations in a metallic part for excess material are determined based on electronic modelling prior to forming. A metallic part is contacted for forming at one or more contact locations away from as-cut end surfaces of the metallic part, such that the as-cut end surfaces are unconstrained during forming. The excess material is then caused, based on the one or more contact locations and the excess material at the one or more target locations, to flow in one or more specific directions during forming. This decreases the residual stress in the metallic part and reduces springback behavior in the metallic part after forming.

Causing the excess material to flow in one or more specific directions during forming produces patterns of plastic and elastic tension and compression in different areas of the metallic part, that decrease the residual stress in the metallic part and reduce springback behavior in the metallic part after forming. In some embodiments, compressive stresses are overlayed on tensile stresses to reduce and/or eliminate effects caused by the tensile (and/or other) stresses. Causing the excess material to flow in one or more specific directions during forming also produces balanced opposite bending moments on either side of a target location, which also tends to decrease the residual stress in the metallic part and reduce springback behavior in the metallic part after forming.

Figure 1:
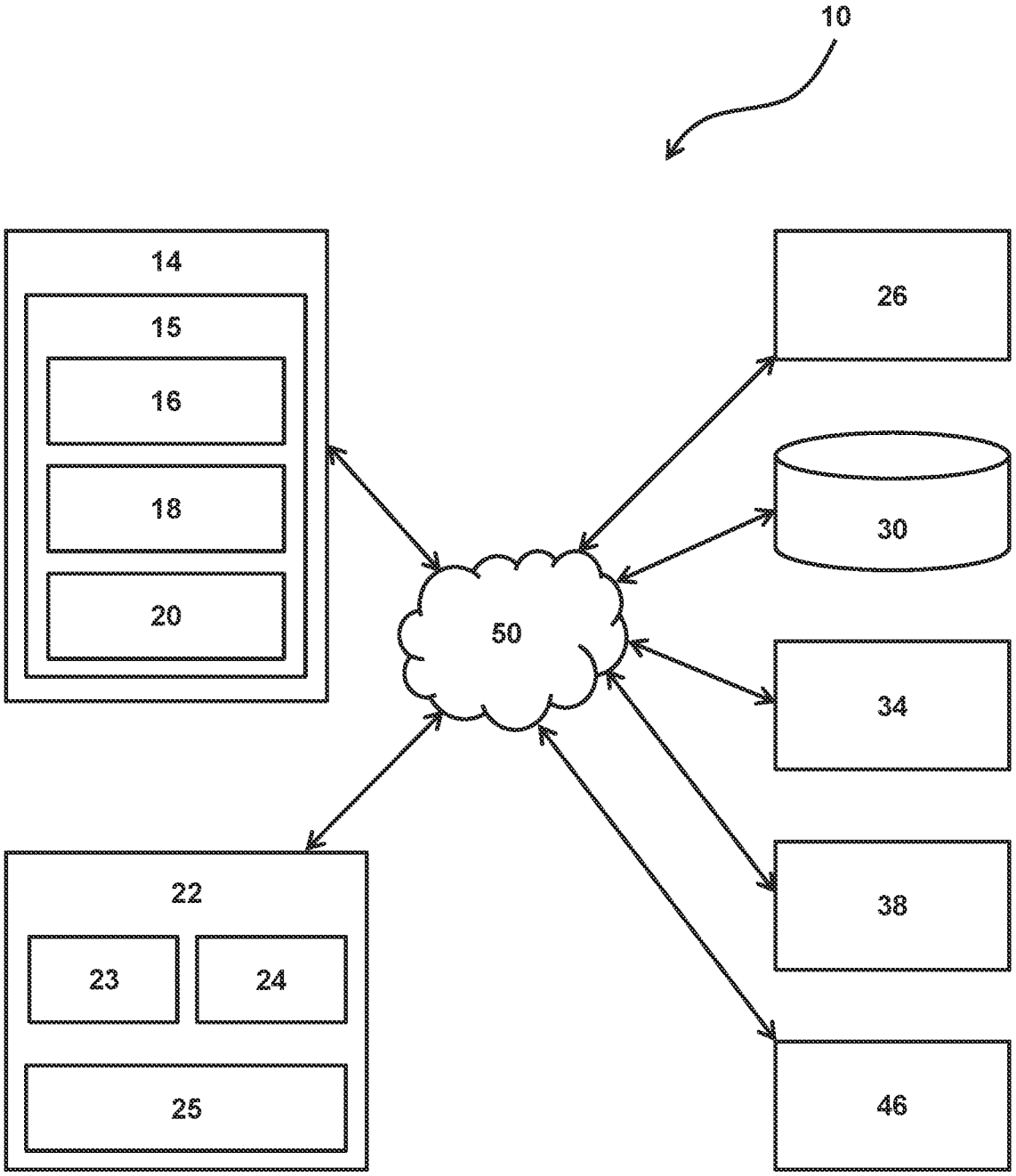
FIG. 1 illustrates a system for forming a metallic part, in accordance with one or more embodiments.

FIG. 1 illustrates a system 10 for forming a metallic part. In some embodiments, system 10 comprises a processor 14, a forming tool 22, a server 26, a data store 30, a mobile user device 34, a desktop user device 38, external resources 46, a network 50, and/or other components. Each of these components is described, in turn, below.

Processor 14 is configured to provide information-processing capabilities in system 10. As such, processor 14 may comprise one or more of a digital processor, an analog processor, a digital circuit designed to process information, an analog circuit designed to process information, a state machine, and/or other mechanisms for electronically processing information. Although processor 14 is shown in FIG. 1 as a single entity, this is for illustrative purposes only. In some embodiments, processor 14 may comprise a plurality of processing units. These processing units may be physically located within the same device (e.g., forming tool 22, server 26, mobile user device 34, desktop user device 38, etc.), or processor 14 may represent processing functionality of a plurality of devices operating in coordination. In some embodiments, processor 14 may be and/or be included in a computing device such as a desktop computer, a laptop computer, a smartphone, a tablet computer, a server, and/or other computing devices. These computing devices may run one or more electronic applications having graphical user interfaces configured to facilitate user interaction with system 10. In some embodiments, processor 14 may be included in and/or control forming tool 22, for example.

As shown in FIG. 1, processor 14 is configured by machine readable instructions 15 to execute one or more computer program components 16, 18, and 20. The computer program components may comprise software programs and/or algorithms coded and/or otherwise defined by machine readable instructions 15 and/or embedded in processor 14, for example. The one or more computer program components may comprise one or more of a modelling component 16, a target location component 18, a control component 20, and/or other components. Processor 14 may be configured to execute components 16, 18, 20, and/or other components by software; hardware; firmware; some combination of software, hardware, and/or firmware; and/or other mechanisms for configuring processing capabilities on processor 14.

It should be appreciated that although components 16, 18, and 20 are illustrated in FIG. 1 as being co-located in processor 14, one or more of the components 16, 18, or 20 may be located remotely from the other components. The description of the functionality provided by the different components 16, 18, and/or 20 described below is for illustrative purposes, and is not intended to be limiting, as any of the components 16, 18, and/or 20 may provide more or less functionality than is described, which is not to imply that other descriptions are limiting. For example, one or more of the components 16, 18, and/or 20 may be eliminated, and some or all of its functionality may be provided by others of the components 16, 18, and/or 20, again which is not to imply that other descriptions are limiting. As another example, processor 14 may include one or more additional components that may perform some or all of the functionality attributed below to one of the components 16, 18, and/or 20.

Modelling component 16 is configured to electronically model residual stresses in a metallic part caused by forming. Forming may include one or more preforming steps, a final forming step, and/or other forming steps. In some embodiments, the metallic part is a sheet metal part, or a part produced from sheet metal. In some embodiments, the metallic part comprises a floor pan, battery tray, a U model beam, and/or other metallic parts, for example. (Note that the principles described in this application may be applied to any number of different types of metallic parts.) In some embodiments, the electronic modelling comprises predicting stresses in the metallic part caused by forming (e.g., in one or all of the individual steps of a forming process). In some embodiments, the electronic modelling comprises predicting stresses in the metallic part caused by forming using finite element analysis (FEA). FEA comprises a method for numerically solving differential and/multi-dimensional algorithms (e.g., equations) that describe a metallic part and the stresses that develop during forming. Using FEA, a metallic part is divided into smaller parts (called finite elements) by constructing a mesh that represents the metallic part. The algorithms that describe the metallic part and the stresses that develop during forming are solved for each finite element of the mesh, for each forming step, and then aggregated. Stresses in the metallic part caused by forming are predicted based on the aggregation and/or other information.

In some embodiments, input to an FEA model comprises the material that forms the part, properties of the material, part geometry, and/or other information. The FEA model may output predictions in the form of a stress map, for example, showing the types (e.g., elastic, plastic, tensile, compressive) and locations of stresses around the part.

In some embodiments, electronically modelling residual stresses in a metallic part caused by forming includes varying a hypothetical location (or locations) of excess material in a model of the metallic part, and repeating the prediction of the stresses accordingly (e.g., re-running an FEA model for each step of a forming process). In some embodiments, the predicted stresses comprise tensile stresses caused by material deformation, compressive stresses in local areas of the metallic part induced by the excess material, and/or other stresses, for example. In some embodiments, the hypothetical location (or locations) of the excess material may be varied such that an intensity of the predicted stresses at one or more target locations in a metallic part (or at several locations across the metallic part) remains below a threshold stress level, for example. The threshold stress level may be set by a user (e.g., using a user interface described below), determined automatically by modelling component 16 (e.g., based on programmed relationships between stress levels and springback), and/or determined in other ways. In some embodiments, the hypothetical location (or locations) of the excess material may be varied such that an intensity of the predicted stresses at one or more target location locations in a metallic part (or at several locations across the metallic part) is minimized and/or otherwise optimized to reduce residual stresses, for example.

In some embodiments, as described above, the modelling may be performed by one or more algorithms (e.g., as with FEA). The one or more algorithms may be and/or include mathematical equations, plots, charts, and/or other tools and model components. For example, in some embodiments, the present systems and methods include (or use) an FEA model that comprises one or more multi-dimensional algorithms. The one or more multi-dimensional algorithms comprise one or more non-linear, linear, or quadratic functions representative of the behavior of a metallic part during forming. Modelling may predict outputs based on correlations between various inputs (e.g., metallic part shape, material properties, forming parameters, etc.). The modelling algorithms and/or other parameters may be adjusted by comparing one or more different model outputs, generated based on known inputs, to corresponding target outputs for the known inputs, and adjusting one or more algorithms to reduce or minimize a difference between an output and a target output, for a corresponding input.

In some embodiments, the modelling described herein can include and/or be performed by a neural model in addition to and/or instead of the one or more algorithms described above. For example, in some embodiments, the modelling may be performed by a machine learning model and/or any other parameterized model. In some embodiments, the machine learning model (for example) may be and/or include mathematical equations, algorithms, plots, charts, networks (e.g., neural networks), and/or other tools and machine learning model components. For example, the machine learning model may be and/or include one or more neural networks having an input layer, an output layer, and one or more intermediate or hidden layers. In some embodiments, the one or more neural networks may be and/or include deep neural networks (e.g., neural networks that have one or more intermediate or hidden layers between the input and output layers).

As an example, the one or more neural networks may be based on a large collection of neural units (or artificial neurons). The one or more neural networks may loosely mimic the manner in which a biological brain works (e.g., via large clusters of biological neurons connected by axons). Each neural unit of a neural network may be connected with many other neural units of the neural network. Such connections can be enforcing or inhibitory in their effect on the activation state of connected neural units. In some embodiments, each individual neural unit may have a summation function that combines the values of all its inputs together. In some embodiments, each connection (or the neural unit itself) may have a threshold function such that a signal must surpass the threshold before it is allowed to propagate to other neural units. These neural network systems may be self-learning and trained, rather than explicitly programmed, and can perform significantly better in certain areas of problem solving, as compared to traditional computer programs. In some embodiments, the one or more neural networks may include multiple layers (e.g., where a signal path traverses from front layers to back layers). In some embodiments, back propagation techniques may be utilized by the neural networks, where forward stimulation is used to reset weights on the "front" neural units. In some embodiments, stimulation and inhibition for the one or more neural networks may be freer flowing, with connections interacting in a more chaotic and complex fashion. In some embodiments, the intermediate layers of the one or more neural networks include one or more convolutional layers, one or more recurrent layers, and/or other layers.

The one or more neural networks may be trained (i.e., whose parameters are determined) using a set of training information. The training information may include a set of training samples. Each sample may be a pair comprising an input object (typically a vector, which may be called a feature vector) and a desired output value (also called the supervisory signal). A training algorithm analyzes the training information and adjusts the behavior of the neural network by adjusting the parameters (e.g., weights of one or more layers) of the neural network based on the training information. For example, given a set of N training samples of the form $\{(x_1, y_1), (x_2, y_2), \ldots, (x_N, y_N)\}$ such that xi is the feature vector of the i-th example and yi is its supervisory signal, a training algorithm seeks a neural network g: $X \rightarrow Y$, where X is the input space and Y is the output space. A feature vector is an n-dimensional vector of numerical features that represent some object (e.g., the dimensions of a part to be formed, forming parameters, material properties, etc.). The vector space associated with these vectors is often called the feature space. After training, the neural network may be used for making predictions (e.g., whether and/or how much springback will occur) using new samples.

Target location component 18 is configured to determine one or more target locations in the metallic part for excess material. The one or more target locations are determined based on the electronic modelling prior to forming, and/or other information. The excess material in the target locations is configured to decrease residual stress in the metallic part after forming. This may reduce and/or eliminate springback, for example. In some embodiments, the one or more target locations may be and/or correspond to one or more of the hypothetical locations of excess material used during modelling. For example, the one or more target locations may include locations that cause the intensity of the predicted stresses at the one or more target locations (or other locations) in the metallic part to remain below a threshold stress level, for example, and/or such that an intensity of the predicted stresses is minimized.

In some embodiments, the excess material comprises a bulging arcuate portion of the metallic part that would not normally have been provided for forming the metallic part. In some embodiments, the excess material comprises an excess length of line of the metallic part that would not normally have been provided for forming the metallic part. In some embodiments, the one or more target locations comprise a bend between a base and a sidewall of the metallic part. In some embodiments, a metallic part is formed with the excess material in the one or more target locations during a pre-forming process that occurs before the (final) forming process.

Figure 2:
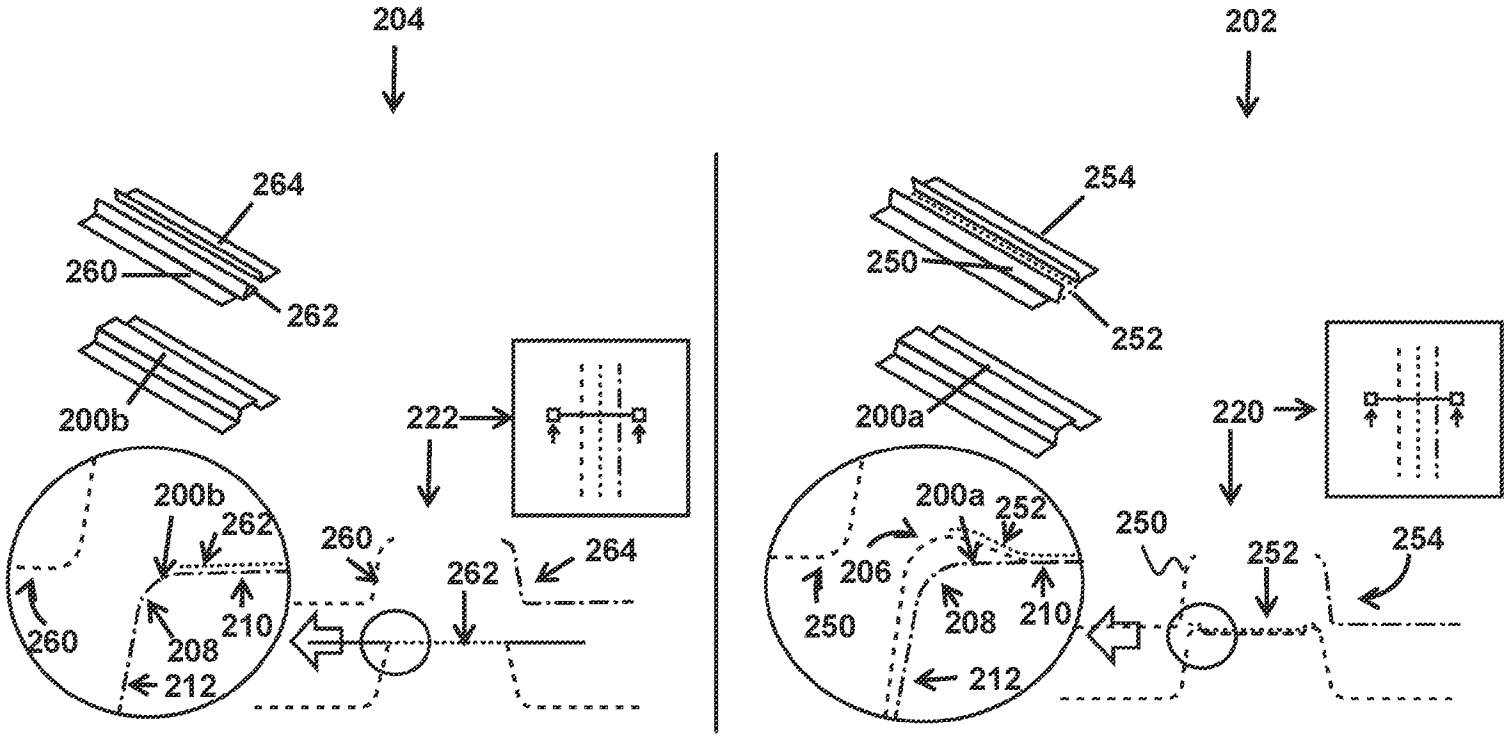
FIG. 2 illustrates a comparison between pre-forming a metallic part with and without excess material, in accordance with one or more embodiments.

By way of a non-limiting example, FIG. 2 illustrates a comparison between pre-forming (e.g., a preforming step of a forming process) a metallic part 200*a* or 200*b* with 202 (200*a*) and without 204 (200*b*) excess material 206. In this example, metallic part 200*a*/200*b* is a U model beam. Excess material 206 comprises a bulging arcuate portion of metallic part 200*a* that would not normally have been provided for forming metallic part 200*b*. As shown in the cross sectional images 220 and 222 in FIG. 2, excess material 206 is located at a target location comprising a bend 208 between a base 210 and a sidewall 212 of metallic part 200*a*. FIG. 2 illustrates forming metallic part 200*a* with die components 250, 252, and 254 (e.g., parts of die 24, which is shown in FIG. 1 and further described below), and metallic part 200*b* with die components 260, 262, and 264. These die components are similar, except that component 252 is formed with arcuate ends relative to component 262 to create the bulging arcuate portion (at the target location of bend 208) of metallic part 200*a* and provide excess material 206, as shown in FIG. 2 (e.g., see 202).

Returning to FIG. 1, control component 20 is configured to cause the excess material to flow during forming. This may include controlling the movement of forming tool 22, for example, and/or other operations. Controlling the movement of forming tool 22 may include sending an electronic control signal to forming tool 22, and/or other control operations. Controlling the movement of forming tool 22 may be based on a shape of the metallic part, forming parameters, locations of excess material, characteristics of forming tool 22, and/or other information. Controlling the movement of forming tool 22 may include specifying rates, directions, and/or distances travelled by one or more die(s) 24 of forming tool 22, and/or other components. Controlling the movement of forming tool 22 may include controlling the movement of one or more die(s) 24 to compress, stretch, and/or bend sheet metal to form a metallic part. The die(s) 24 may impart a specific shape to the sheet metal to form the metallic part. The compression may be performed in one or more steps. The one or more steps may include a pre-forming step and a final forming step, for example, and/or other steps.

In some embodiments, control component 20 is configured to determine one or more parameters of forming tool 22, and control forming tool 22 based on those parameters. The one or more parameters of forming tool 22 may comprise distances, directions, pressures, forces, temperatures, times, and/or other parameters. Control component 20 may be configured to determine the one or more parameters based on the output signals of sensors included in forming tool 22, based on the modelling and/or target location determination described above, based on a make and/or model of forming tool 22, based on one or more shapes of dies components included in forming tool 22, and/or other information.

Control component 20 is configured such that the excess material is caused to flow in one or more specific directions during forming to decrease the residual stress in the metallic part and reduce springback behavior in the metallic part after forming. In some embodiments, causing the excess material to flow in one or more specific directions during forming produces: (1) a pattern of plastic compression in the sidewall, elastic compression in the bend, and plastic tension in the base, on an outside radius of the bend; and (2) a corresponding pattern of plastic tension in the sidewall, elastic tension in the bend, and plastic compression in the base, on an inside radius of the bend. This decreases the residual stress in the metallic part and reduces springback behavior in the metallic part after forming. In some embodiments, causing the excess material to flow in one or more specific directions during forming produces balanced opposite bending moments on either side of the bend to decrease the residual stress in the metallic part and reduces springback behavior in the metallic part after forming. This is further described below in relation to FIG. 3-FIG. 6.

Figure 3:
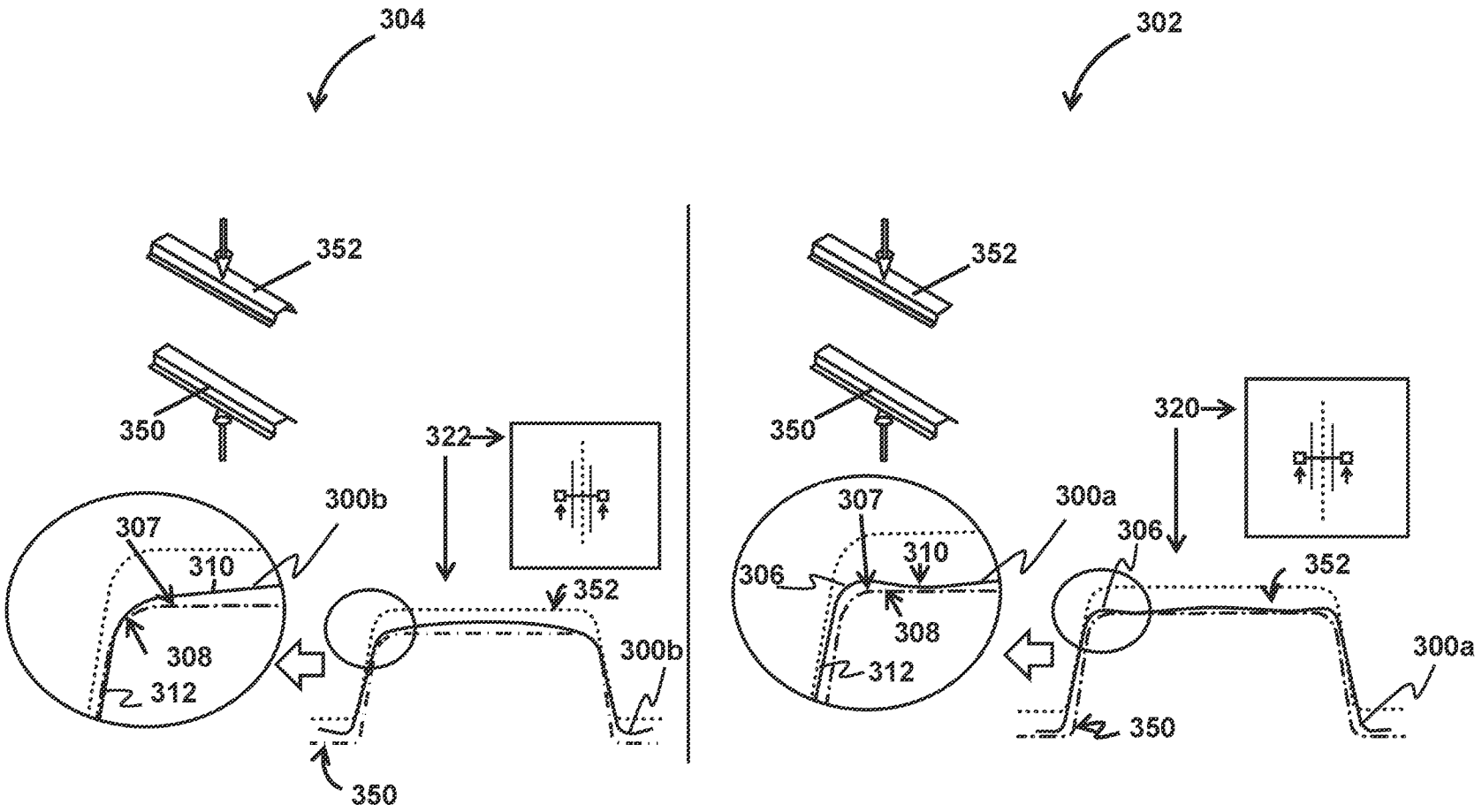
FIG. 3 illustrates a comparison between final forming a metallic part with and without excess material, in accordance with one or more embodiments.

FIG. 3 illustrates a comparison between (final) forming a metallic part 300*a* or 300*b* with 302 (300*a*) and without 304 (300*b*) excess material 306. In this example, metallic part 300*a*/300*b* is again a U model beam. Metallic part 300*a*/300*b* is illustrated relative to a final target part shape 307. Excess material 306 comprises a bulging arcuate portion of metallic part 300*a* that would not normally have been provided for forming metallic part 300*b*. As shown in the cross sectional images 320 and 322 in FIG. 3, excess material 306 is located at a target location comprising a bend 308 between a base 310 and a sidewall 312 of metallic part 300*a*. FIG. 3 illustrates (final) forming metallic part 300*a*/300*b* with die components 350 and 352 (e.g., parts of die 24, which is shown in FIG. 1 and further described below). FIG. 3 illustrates how, when part 300*b* is formed without excess material, it springs back to a generally bowed or arched shape compared to final target part shape 307. In contrast, part 300*a*, which is formed using excess material 306, more closely conforms to final target part shape 307 after (final) forming.

Figure 4:
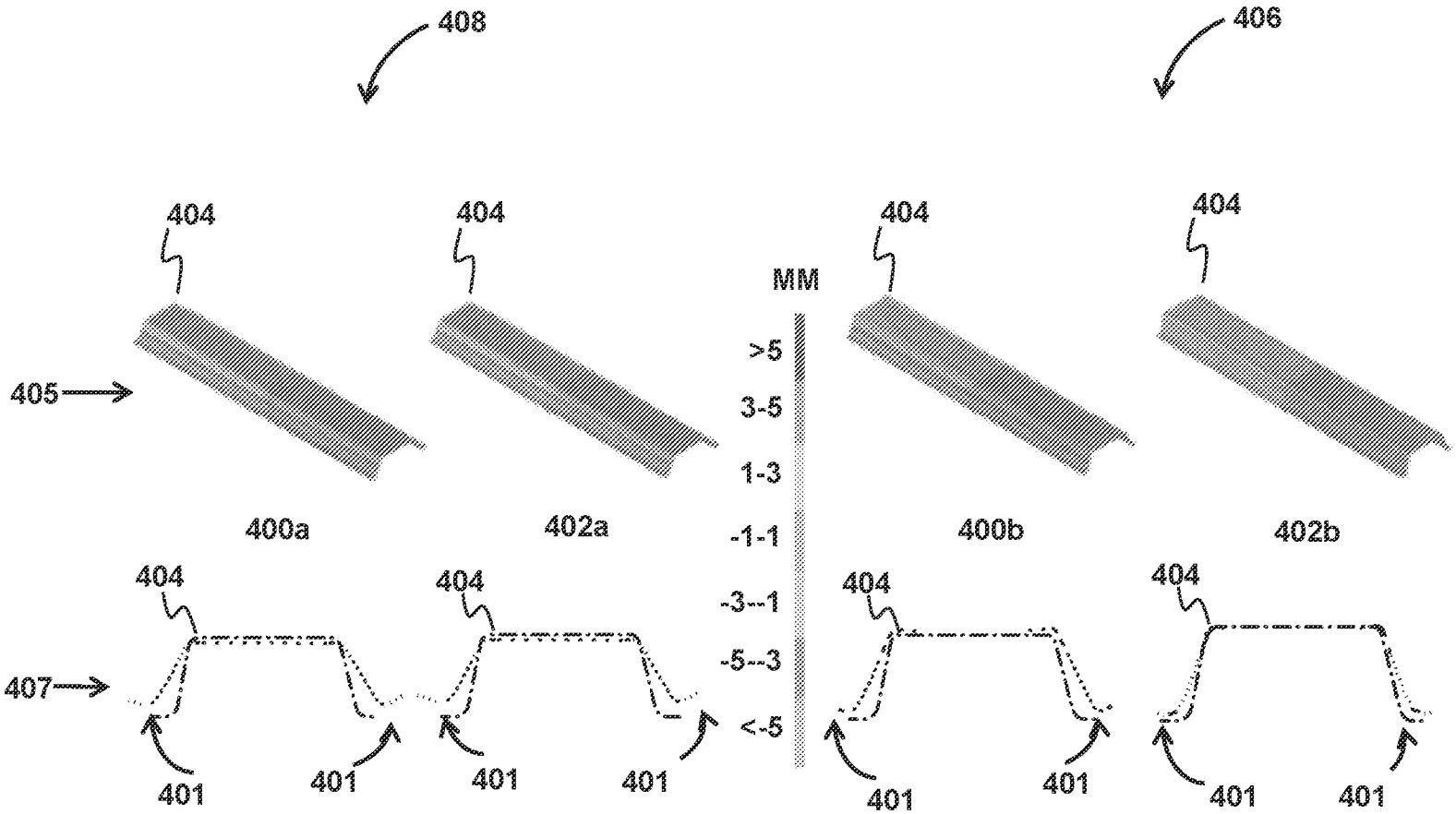
FIG. 4 illustrates a comparison between springback after pre-forming and final forming a metallic part with and without excess material (e.g., modelled and pre-formed as described herein), in accordance with one or more embodiments.

FIG. 4 illustrates a comparison between springback 401 (in mm) after pre-forming 400*a*/400*b* and final forming 402*a*/402*b* a metallic part 404 (shown in corresponding perspective 405 and cross-sectional 407 views) with 406 and without 408 excess material (e.g., modelled and preformed as described above). In this example, metallic part 404 is again a U model beam. Comparing springback 401 after pre-forming 400*a* to 400*b*, and springback 401 after final forming 402*a* to 402*b*, it is clear that springback 401 after forming (pre-forming or final forming) is reduced if excess material is used as described herein. Specifically, there is less springback 401 after pre-forming 400*b* compared to 400*a*, and less springback 401 after final forming 402*b* compared to 402*a*.

Figure 5:
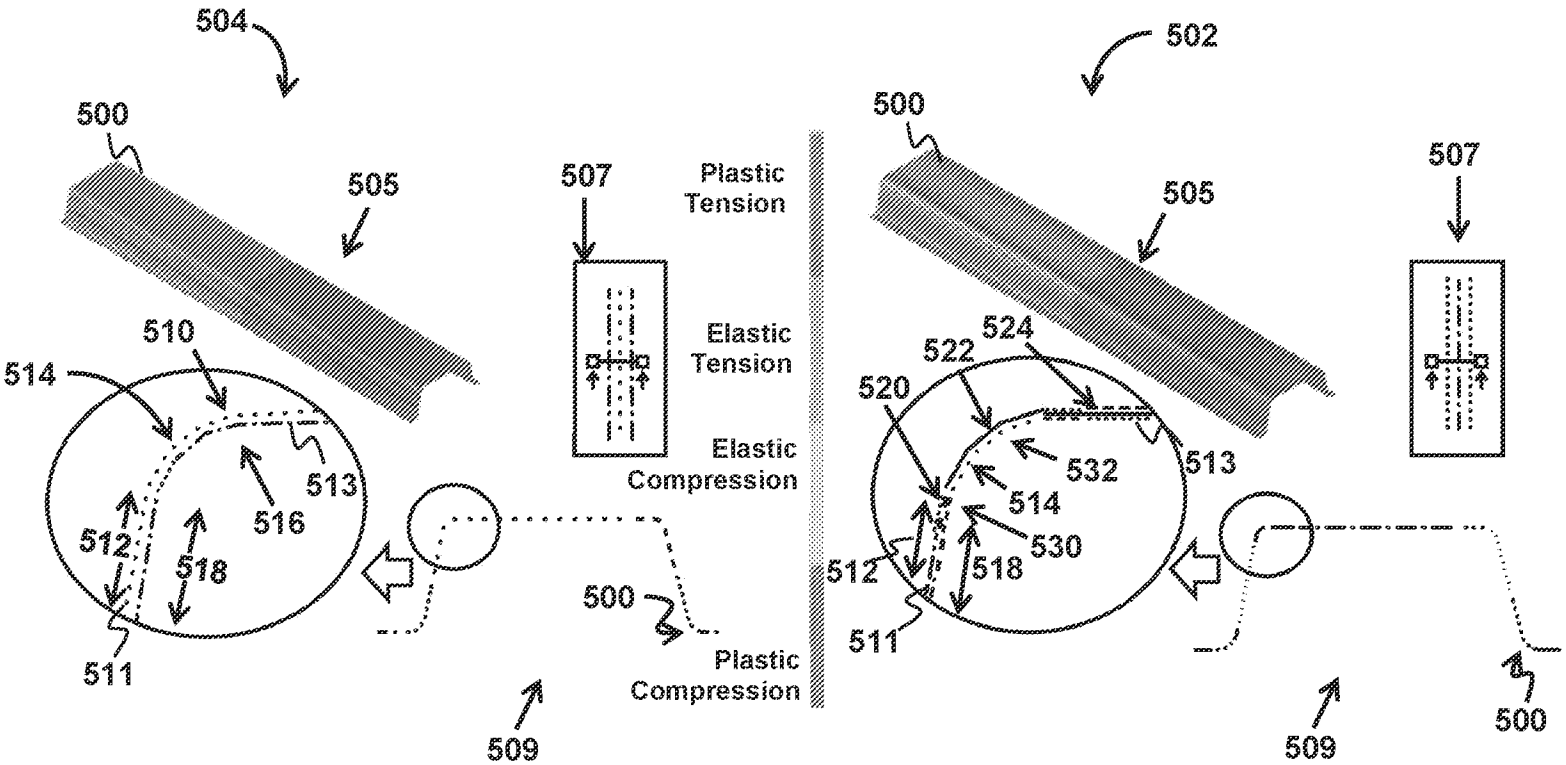
FIG. 5 illustrates a comparison between compressive and tensile states of a metallic part after forming with and without excess material (e.g., modelled and preformed as described herein), in accordance with one or more embodiments.

FIG. 5 illustrates a comparison between compressive and tensile states of a metallic part 500 after forming with 502 and without 504 excess material (e.g., modelled and pre-formed as described above). Tensile stresses caused by certain geometry are a natural effect of stamping processes. The present systems and methods add and/or cause compressive stresses in specific locations around a part. This (e.g., changing geometry to produce compressive stresses) addresses a root cause of springback, instead of merely trying to mitigate springback with compensation techniques (e.g., overbend, varied process parameters, etc.). In the example shown in FIG. 5, metallic part 500 is again a U model beam and is shown in perspective (505), overhead (507), and cross-sectional (509) views. Forming metallic part 500 without 504 excess material produces areas of constant stress in metallic part 500, which can cause springback. For example, forming metallic part 500 without 504 excess material produces an area of elastic tension 510 in a sidewall 511, on an outside radius 512 of a bend 514, and in a base 513 in part 500; and an area of elastic compression 516 on an inside radius 518 in the sidewall of bend 514. In contrast, modelling and/or forming metallic part 500 with 502 excess material as described herein (e.g., see FIG. 2) produces areas of alternating stress. For example, forming metallic part 500 with 502 excess material produces: (1) a pattern of plastic compression 520 in sidewall 511, elastic compression 522 in bend 514, and plastic tension 524 in base 513, on outside radius 512 of bend 514; and (2) a corresponding pattern of plastic tension 530 in sidewall 511, elastic tension 532 in bend 514, and plastic compression 534 in base 513, on inside radius 518 of bend 514. This pattern of compression and tension decreases the residual stress in metallic part 500 and reduces springback behavior in metallic part 500 after forming.

Figure 6:
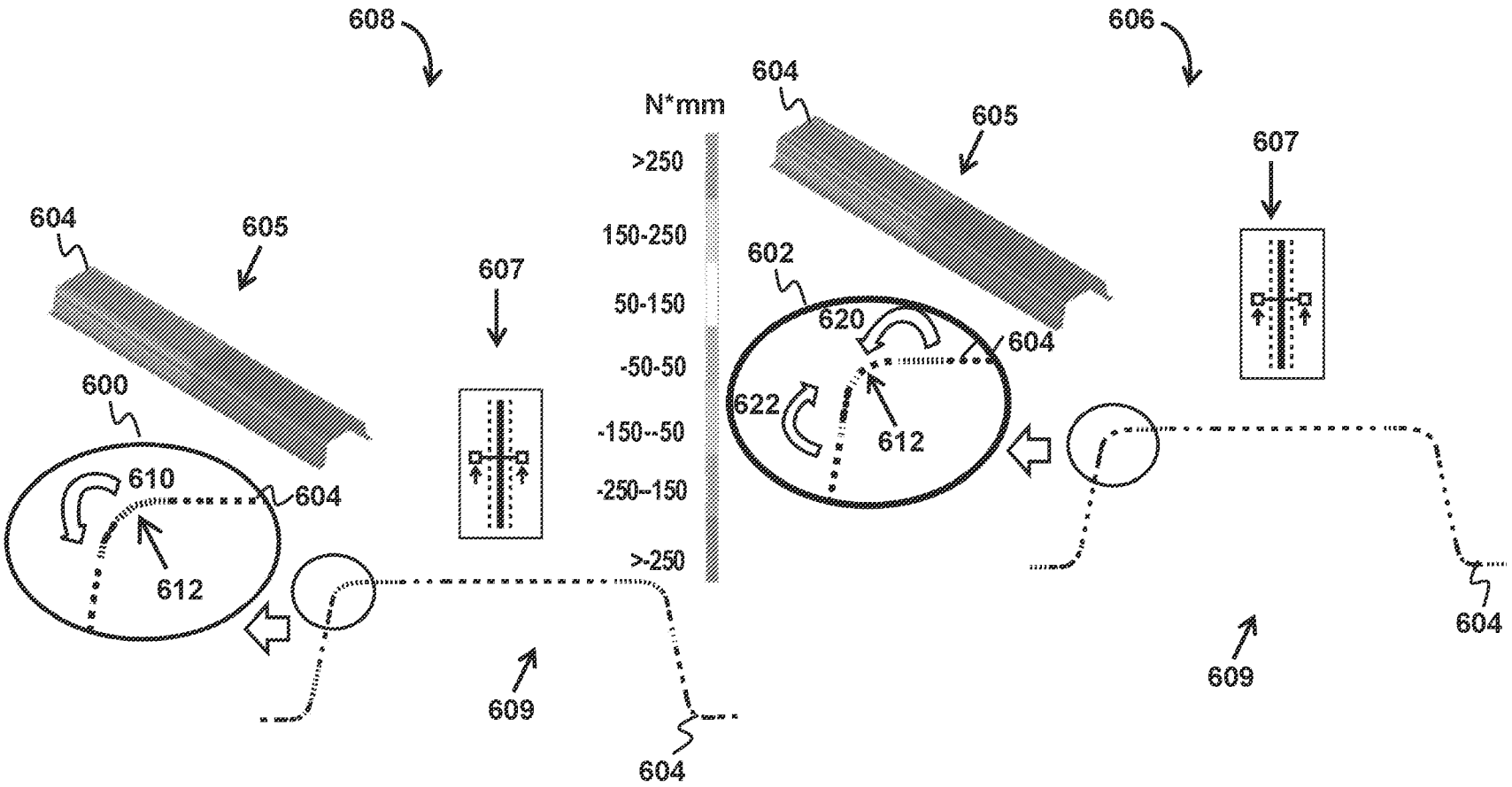
FIG. 6 illustrates a comparison between bending moments in a metallic part after forming with and without excess material (e.g., modelled and formed as described herein), in accordance with one or more embodiments.

FIG. 6 illustrates a comparison between bending moments 600 and 602 (in N*mm units) in a metallic part 604 after forming with 606 and without 608 excess material (e.g., modelled and formed as described above). In this example, metallic part 604 is again a U model beam and is shown in perspective (605), overhead (607), and cross-sectional (609) views. Forming metallic part 604 without 608 excess material produces a bending moment 610 at or near a bend 612 of metallic part 604, which can cause springback (e.g., and the larger the bending moment, the larger the springback). In contrast, modelling and/or forming metallic part 604 with 606 excess material as described herein (e.g., see FIG. 2) produces balanced opposite bending moments 620 and 622 on either side of bend 612 to decrease the residual stress in metallic part 604, and reduce springback behavior after forming.

Figure 7:
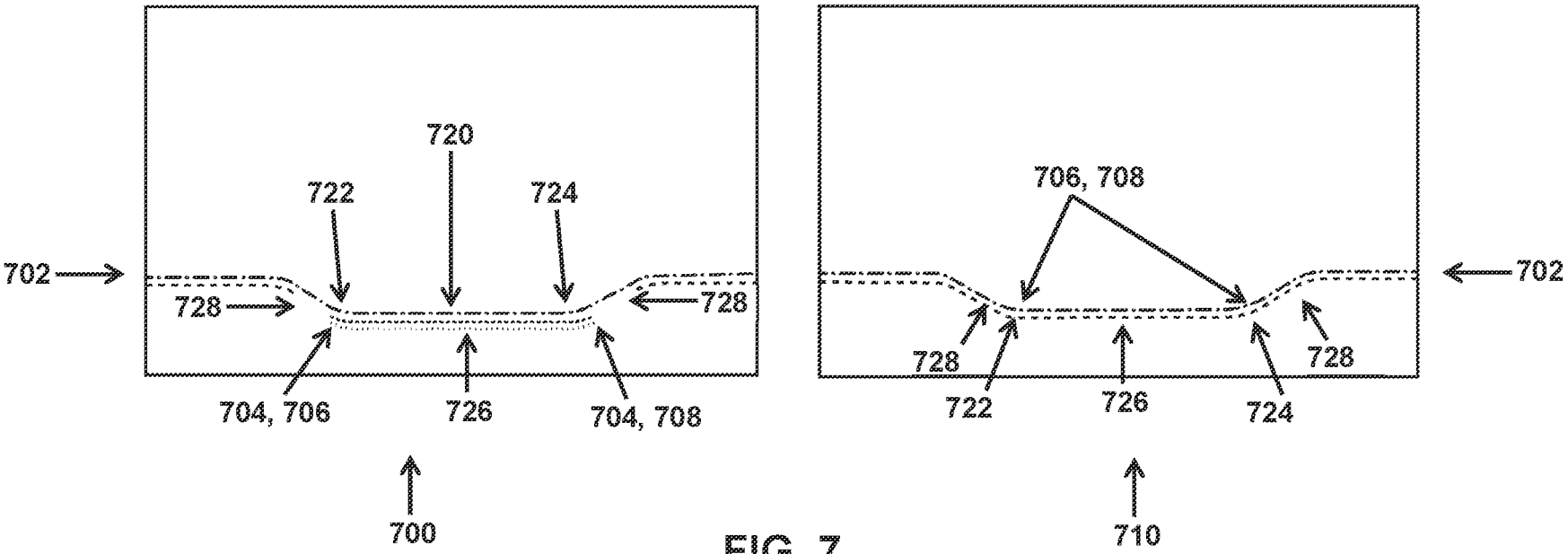
FIG. 7 illustrates another example of pre-forming a metallic part so it includes excess material at target locations, and then final forming the metallic part, in accordance with one or more embodiments.

In some embodiments, as described above, control component 20 (FIG. 1) is configured to control forming tool 22 (FIG. 2) to pre-form a metallic part so it includes the excess material at the one or more target locations, and then (final) form the metallic part as described above. In the example shown in FIG. 2, the excess material comprises a bulging arcuate portion of the metallic part that would not normally have been provided for forming the metallic part. FIG. 7 illustrates another example of pre-forming 700 a metallic part 702 (viewed in cross-section) so it includes excess material 704 at target locations 706 and 708, and then final forming 710 metallic part 702. In the example shown in FIG. 7, metallic part 702 is preformed to a depth that is deeper (e.g., by 2 mm in this example) that a nominal depth 720. This creates excess material in or around the transitions 722, 724 (e.g., the bends) between the base 726 and the sidewalls 728 of metallic part 702. Metallic part is then final formed 710 back to nominal depth 720. Other examples of pre-forming a metallic part so it includes excess material at target locations, and then final forming the metallic part are contemplated.

Returning to FIG. 1, forming tool 22 is configured to form metal parts. Forming tool 22 may be configured for pre-forming, final forming, and/or other operations. Forming tool is configured to be controlled by control component 20, by a user via entries and/or selections made through a user interface integral to forming tool 22 and/or other components of system 10, and/or controlled in other ways. Forming tool 22 may be controlled based on a shape of the metallic part, forming parameters, locations of excess material, characteristics of forming tool 22, and/or other information. Forming tool 22 may be controlled to move at certain rates of speed, in certain directions, and/or across certain distances, for example. Forming tool 22 may be configured to compress, stretch, and/or bend sheet metal to form a metallic part. Forming tool 22 is configured to cause the excess material to flow in one or more specific directions during forming to decrease the residual stress in a metallic part and reduce springback behavior in the metallic part after forming. In some embodiments, forming tool 22 may include one or more contacts 23, one or more dies 24, a power source 25 configured to generate forces for forming, and/or other components.

Contact(s) 23 is configured to contact the metallic part for forming. In some embodiments, contact(s) 23 may be formed by die(s) 24 and/or portion(s) of dies 24. The metallic part is contacted for forming at one or more contact locations away from as-cut end surfaces of the metallic part, such that the as-cut end surfaces are unconstrained during forming. In some embodiments, contacting comprises holding and/or compressing the metallic part between two opposing surfaces of a die that span the bend from the base to the sidewall.

Die(s) 24 are configured to impart a specific shape to a metal part. Die 24 may be configured to deform sheet metal, for example. Die 24 may include an upper die, a lower die, and/or other components. For example, die 24 may include one or more punches and one or more die blocks (e.g., for different steps in the forming process). Each of these may be configured to produce a desired shape or profile in the metallic part. In some embodiments, die 24 may be stamping die, for example, that is customized for a specific metal part. In a stamping die, material is brought between an upper and lower die, and using the die(s) to apply forces to the part to deform the part. A punch (e.g., formed by and/or included in an upper die) typically performs the stretching and/or bending from one side, while a die block (e.g., formed by and/or included in a lower die) securely holds the part and provides similar stretching and/or bending from the other side. In some embodiments, the lower die may include shoes that hold die components, guide pins, and/or other positioning components.

Figure 8:
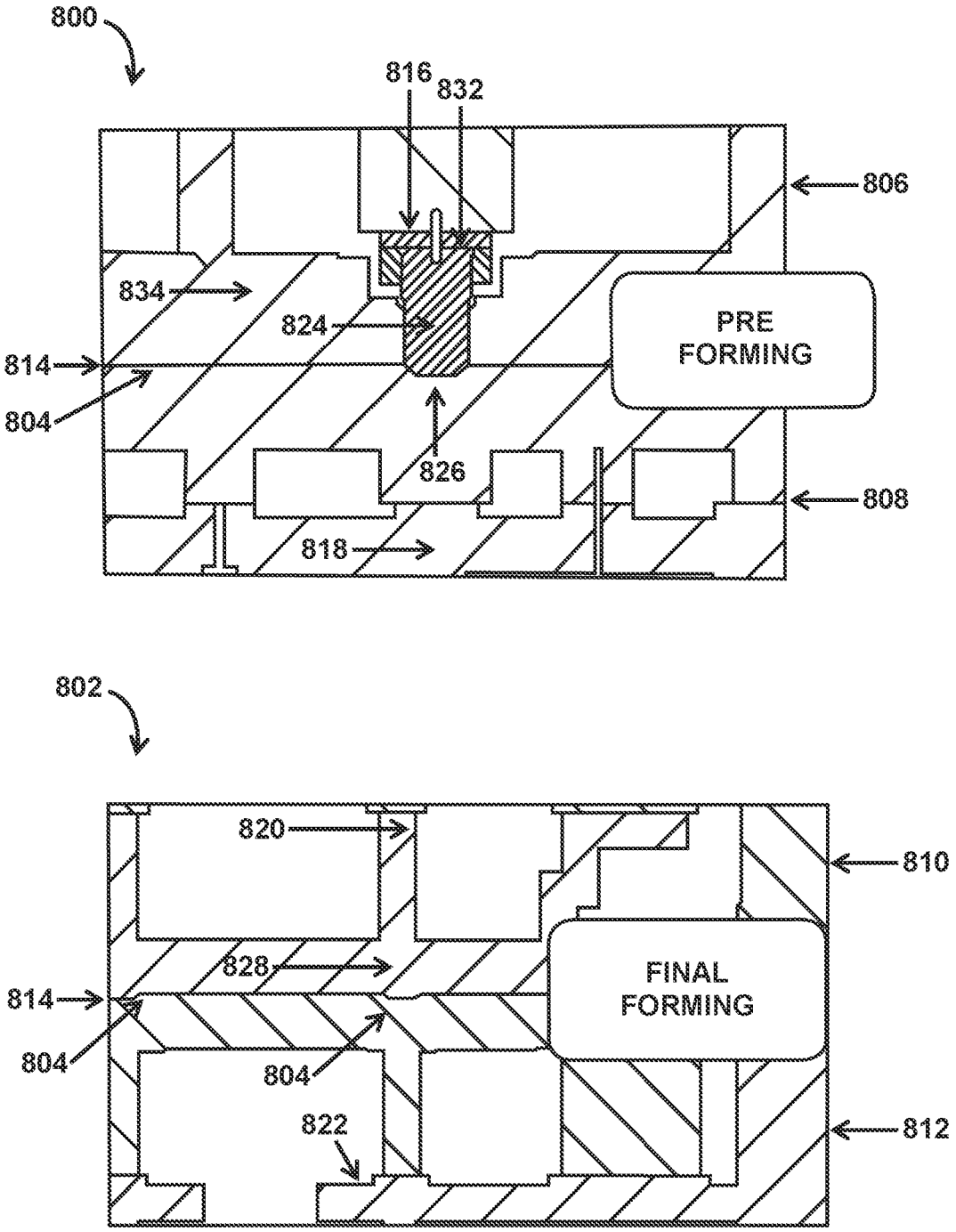
FIG. 8 illustrates examples of various contact and die components that may be included in a forming tool that is part of the present system, in accordance with one or more embodiments.

By way of a non-limiting example, FIG. 8 illustrates examples of various die components that may be included in forming tool 22 (FIG. 1). FIG. 8 illustrates die components during a pre-forming step 800 and a final forming step 802 for a metallic part 804. Pre-forming step 800 comprises an emboss punch, and final forming step 802 comprises a emboss restrike, in this example. As shown in FIG. 8, metallic part 804 is contacted along a length of the part by upper and lower portions of a die (e.g., upper and lower portions 806 and 808 respectively during the pre-forming step 800, and upper and lower portions 810 and 812 respectively during final forming step 802), but not at the ends 814 of metallic part 804. Each of these portions may include upper and/or lower shoes (816, 818, 820, 822), punches (824, 826, 828, 830), shims 832, pads, 834, and/or other components. Note that, advantageously, the die components shown in FIG. 8 are shimable. In other words, shims may be used to provide slight adjustments to the shape of a pre-formed part (e.g., a part can be pre-formed slightly deeper as in this example). This adds die and/or other process flexibility to the pre-forming and/or final forming processes.

Returning to FIG. 1, power source 25 of forming tool 22 may be any source of energy configured to be used to move one or more components of forming tool 22. For example, power source 25 may be a motor and/or other power sources. In some embodiments, forming tool 22 may be or include a hydraulic press and the motor may be used to power a hydraulic pump. The hydraulic pump may move hydraulic fluid into and/or out of one or more pistons to move press components of forming tool 22 (e.g., die components) to form a metallic part, for example. In some embodiments, forming 22 may be or include a mechanical press, and the motor may be used to move one or more components to create a mechanical advantage used to move die components and form a metallic part. These examples are not intended to be limiting. Forming tool 22 may be any tool configured to form metallic parts as described herein.

Figure 9:
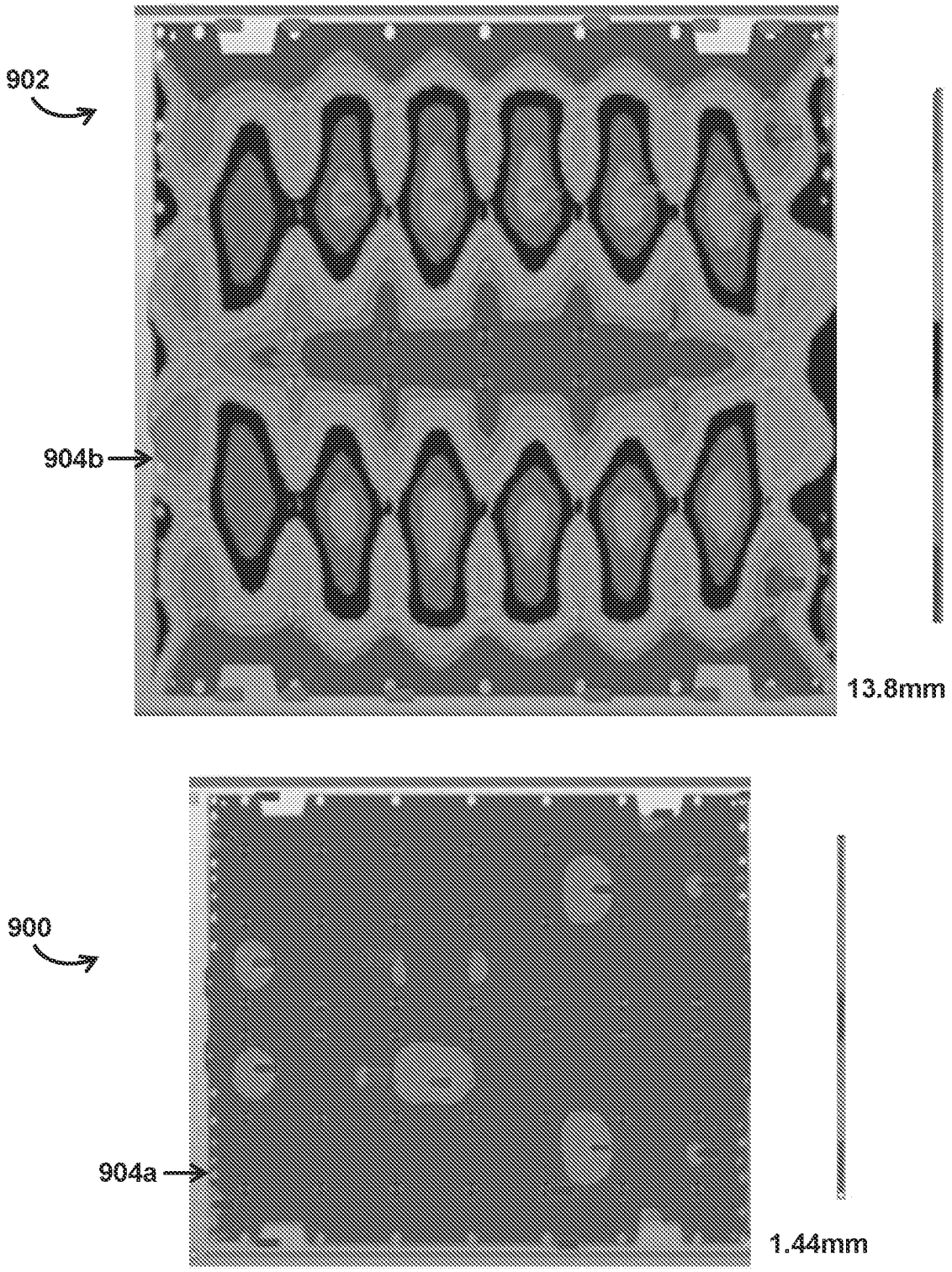
FIG. 9 illustrates the dimensional variability in a metallic part formed with and without the present system(s) and method(s), in accordance with one or more embodiments.

By way of a non-limiting example of the effectiveness of the system(s) and method(s) described herein, FIG. 9 illustrates the dimensional variability in a metallic part formed with 900 and without 902 the present system(s) and method(s). In FIG. 9, the metallic part is a battery tray 904*a*, 904*b*. Battery tray 904*a* was formed with the present system(s) and method(s). Battery tray 904*b* was formed using a conventional process. Dimensional variability (which corresponds to flatness in this example) after forming was measured at various locations across each battery tray. FIG. 9 visually illustrates dimensional variability in the battery trays (904*a*, 904*b*) using different colored shading. More variation in the colors/darkness of the shading corresponds to more dimensional variability in a battery tray. In FIG. 9, battery tray 904*a*, produced with the present systems and methods, clearly has significantly less dimensional variability (e.g., as visually indicated by the fewer colors/shades of battery tray 904*a* shown in FIG. 9) compared to battery tray 904*b*, which was produced with the conventional process. For comparison, battery tray 904*a* has total dimensional variation of approximate 1.5 mm, while battery tray 904*b* varies by about 14 mm (e.g., an undesirable 9X increase in variability).

Returning to FIG. 1, in some embodiments, processor 14 is executed by one or more of the computers described below with reference to FIG. 10. The components of system 10, in some embodiments, communicate with one another in order to provide the functionality of processor 14, forming tool 22, and/or other components described herein. In some embodiments, data store 30 may store data about a metallic part, stress and/or strain, an electronic model of a metallic part, or other information. Server 26 may expedite access to this data by storing likely relevant data in relatively high-speed memory, for example, in random-access memory or a solid-state drive. Server 26 may communicate with webpages and/or other sources of network information. Server 26 may serve data to various applications that process data related to residual stress modelling, and/or other data. The operation of server 26 and data store 30 may be coordinated by one or more processors 14 (which may be located within and/or formed by forming tool 22, server 26, mobile user device 34, desktop user device 38, external resources 46, and/or other computing devices), which may bidirectionally communicate with each of these components or direct the components to communicate with one another. Communication may occur by transmitting data between separate computing devices (e.g., via transmission control protocol/internet protocol (TCP/IP) communication over a network), by transmitting data between separate applications or processes on one computing device; or by passing values to and from functions, modules, or objects within an application or process, e.g., by reference or by value.

In some embodiments, interaction with users (e.g., sending and/or receiving requests for information, etc.) may be facilitated by processor 14, server 26, mobile user device 34, desktop user device 38, and/or other components. This may occur via a website or a native application viewed on forming tool 22, a desktop computer (e.g., desktop user device 38), a mobile computer (e.g., mobile user device 34) such as a tablet, or a laptop of the user. In some embodiments, such interaction occurs via a mobile website viewed on a smart phone, tablet, or other mobile user device, or via a special-purpose native application executing on a smart phone, tablet, or other mobile user device.

To illustrate an example of the environment in which processor 14 operates, the illustrated embodiment of FIG. 1 includes a number of components with which processor 14 communicates: forming tool 22; server 26; data store 30; mobile user device(s) 34; a desktop user device 38; and external resources 46. These devices communicate with processor 14 via a network 50, such as the Internet or the Internet in combination with various other networks, like local area networks, cellular networks, or personal area networks, internal organizational networks, and/or other networks.

Mobile user device(s) 34 may be smart phones, tablets, or other hand-held networked computing devices having a display, a user input device (e.g., buttons, keys, voice recognition, or a single or multi-touch touchscreen), memory (such as a tangible, machine-readable, non-transitory memory), a network interface, a portable energy source (e.g., a battery), and a processor (a term which, as used herein, includes one or more processors) coupled to each of these components. The memory of mobile user device(s) 34 may store instructions that when executed by the associated processor provide an operating system and various applications, including a web browser and/or a native mobile application.

Desktop user device(s) 38 may also include a web browser, a native application, and/or other components. In addition, desktop user device(s) 38 may include a monitor; a keyboard; a mouse; memory; a processor; and a tangible, non-transitory, machine-readable memory storing instructions that when executed by the processor provide an operating system, the web browser, the native application, and/or other components. Native applications and web browsers, in some embodiments, are operative to provide a graphical user interface that communicates with processor 14 and facilitates user interaction with data from processor 14. Web browsers may be configured to receive a website and/or other web based communications from processor 14 having data related to instructions (for example, instructions expressed in JavaScript™) that when executed by the browser (which is executed by a processor) cause mobile user device 34 and/or desktop user device 38 to communicate with processor 14 and facilitate user interaction with data from processor 14. Native applications and web browsers, upon rendering a webpage and/or a graphical user interface from processor 14, may generally be referred to as client applications of processor 14 (and/or server 26, which may include processor 14), which in some embodiments may be referred to as a server. Embodiments, however, are not limited to client/server architectures, and processor 14, as illustrated, may include a variety of components other than those functioning primarily as a server.

In some embodiments, forming tool 22 may include one or more computing components configured to perform one or more of the operations associated with mobile user device 34 and/or desktop user device 38 described above.

External resources 46, in some embodiments, include sources of information such as databases, websites, etc.; external entities participating with system 10 (e.g., systems or networks that store material property data, design files associated with a metallic part (e.g., that specify a shape, thickness, material, etc. of the metallic part), and/or other information); one or more servers outside of the system 10; a network (e.g., the internet); electronic storage; equipment related to Wi-Fi™ technology; equipment related to Bluetooth® technology; data entry devices; or other resources. In some embodiments, some or all of the functionality attributed herein to external resources 46 may be provided by resources included in system 10. External resources 46 may be configured to communicate with processor 14, forming tool 22, server 26, mobile user devices 34, desktop user devices 38, and/or other components of system 10 via wired and/or wireless connections, via a network (e.g., a local area network and/or the internet), via cellular technology, via Wi-Fi technology, and/or via other resources. The number of illustrated processors 14, forming tools 22, external resources 46, servers 26, desktop user devices 38, and mobile user devices 34 is selected for explanatory purposes only, and embodiments are not limited to the specific number of any such devices illustrated by FIG. 1, which is not to imply that other descriptions are limiting.

System 10 includes a number of components introduced above that facilitate requests for formed metallic parts by users, other computing systems, and/or requests from other sources. For example, server 26 may be configured to communicate data about formed part requests, results of those requests, and/or other information via a protocol, such as a representational-state-transfer (REST)-based API protocol over hypertext transfer protocol (HTTP) or other protocols. Examples of operations that may be facilitated by server 26 include requests to display, link, modify, add, or retrieve portions of an electronic model of a metallic part, and/or results of such requests, or other information. API requests may identify which data is to be displayed, linked, modified, added, or retrieved by specifying criteria for identifying records, such as queries for retrieving or processing information about a particular metallic part. In some embodiments, server 26 communicates with the native applications of forming tool 22, mobile user device 34 and desktop user device 38, and/or other components of system 10 (e.g., e.g., to send and/or receive such requests).

Server 26 may be configured to display, link, modify, add, or retrieve portions or all data related a model of a metallic part, results from a particular forming operation, and/or other information encoded in a webpage (e.g. a collection of resources to be rendered by the browser and associated plug-ins, including execution of scripts, such as JavaScript™, invoked by the webpage), or in a graphical user interface display, for example. In some embodiments, a graphical user interface presented by the webpage may include inputs by which the user may enter or select data, such as clickable or touchable display regions or display regions for text input. Such inputs may prompt the browser to request additional data from server 26 or transmit data to server 26, and server 26 may respond to such requests by obtaining the requested data and returning it to the user device or acting upon the transmitted data (e.g., storing posted data or executing posted commands). In some embodiments, the requests are for a new webpage or for data upon which client-side scripts will base changes in the webpage, such as XMLHttpRequest requests for data in a serialized format, e.g. JavaScript™ object notation (JSON) or extensible markup language (XML). Server 26 may communicate with web browsers executed by user devices 34 or 38, a native application run by forming tool 22, and/or other components, for example. In some embodiments, a webpage is modified by server 26 based on the type of user device, e.g., with a mobile webpage having fewer and smaller images and a narrower width being presented to the mobile user device 34, and a larger, more content rich webpage being presented to forming tool 22, and/or desktop user device 38. An identifier of the type of user device, either mobile or non-mobile, for example, may be encoded in the request for the webpage by the web browser (e.g., as a user agent type in an HTTP header associated with a GET request), and server 26 may select the appropriate interface based on this embedded identifier, thereby providing an interface appropriately configured for the specific user device in use.

Data store 30 stores data related to metallic part modelling and/or forming operations, requests for such operations, results from such requests, etc. Data store 30 may include various types of data stores, including relational or nonrelational databases, document collections, hierarchical key-value pairs, or memory images, for example. Such components may be formed in a single database, document, or other component, or may be stored in separate data structures. In some embodiments, data store 30 comprises electronic storage media that electronically stores information. The electronic storage media of data store 30 may include one or both of system storage that is provided integrally (i.e., substantially non-removable) with system 10 and/or removable storage that is removably connectable to system 10 via, for example, a port (e.g., a USB port, a firewire port, etc.) or a drive (e.g., a disk drive, etc.). Data store 30 may be (in whole or in part) a separate component within system 10, or data store 30 may be provided (in whole or in part) integrally with one or more other components of the system 10 (e.g., processors 14, etc.). In some embodiments, data store 30 may be located in a data center, in forming tool 22, in server 26, in a server that is part of external resources 46, in a computing device 34 or 38, or in other locations. Data store 30 may include one or more of optically readable storage media (e.g., optical disks, etc.), magnetically readable storage media (e.g., magnetic tape, magnetic hard drive, floppy drive, etc.), electrical charge-based storage media (e.g., EPROM, RAM, etc.), solid-state storage media (e.g., flash drive, etc.), or other electronically readable storage media. Data store 30 may store software algorithms, information determined by processor 14, information received via a graphical user interface displayed on forming tool 22 and/or computing devices 34 and/or 38, information received from external resources 46, or other information accessed by the system 10 to function as described herein.

Figure 10:
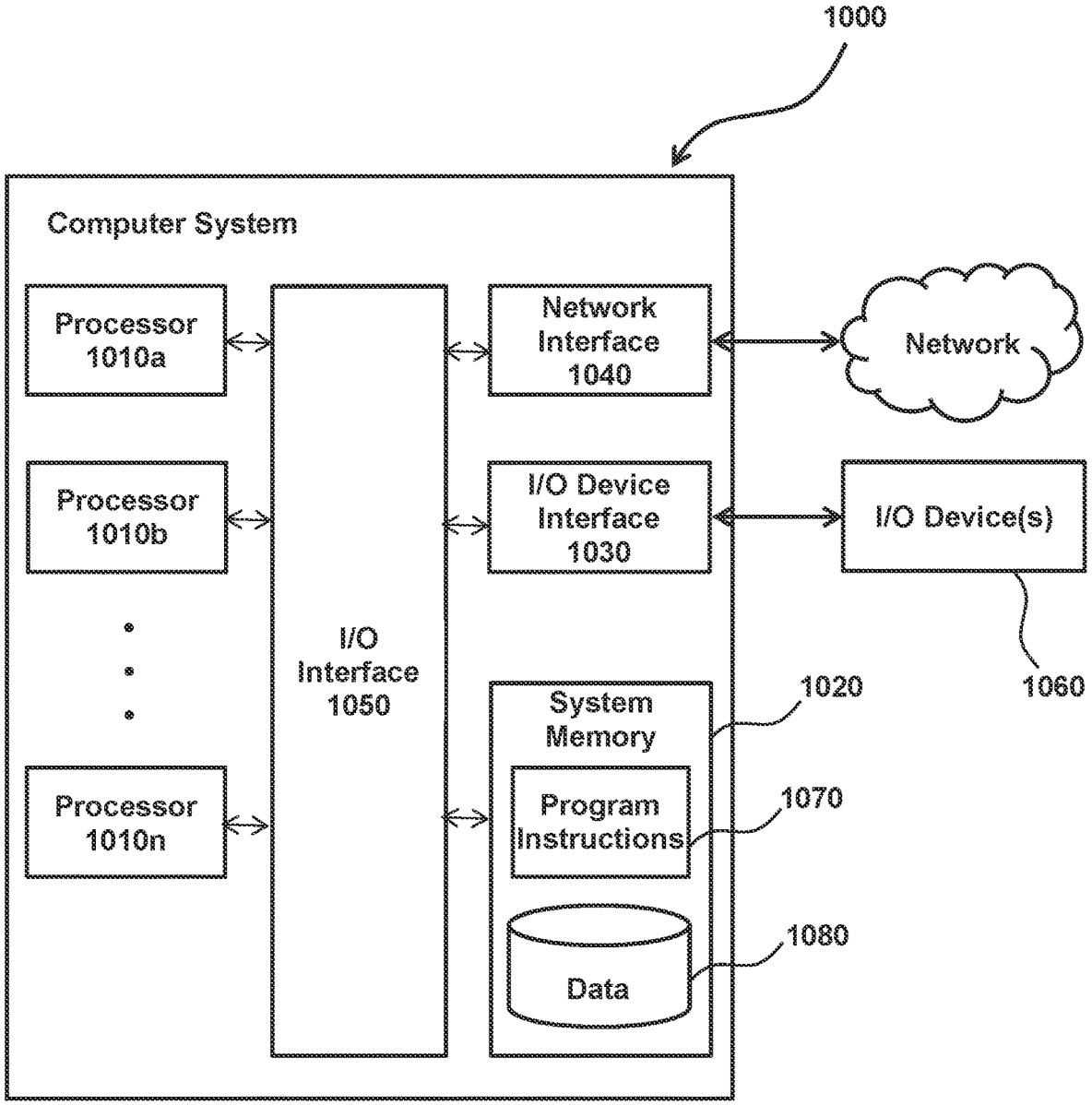
FIG. 10 is a diagram that illustrates an exemplary computing system in accordance with one or more embodiments.

FIG. 10 is a diagram that illustrates an exemplary computing system 1000 in accordance with embodiments of the present system. Various portions of systems and methods described herein, may include or be executed on one or more computer systems the same as or similar to computing system 1000. For example, processor 14, forming tool 22, server 26, mobile user device 34, desktop user device 38, external resources 46 and/or other components of system 10 (FIG. 1) may be and/or include one more computer systems the same as or similar to computing system 1000. Further, processes, modules, processor components, and/or other components of system 10 described herein may be executed by one or more processing systems similar to and/or the same as that of computing system 1000.

Computing system 1000 may include one or more processors (e.g., processors 1010*a*-1010*n*) coupled to system memory 1020, an input/output I/O device interface 1030, and a network interface 1040 via an input/output (I/O) interface 1050. A processor may include a single processor or a plurality of processors (e.g., distributed processors). A processor may be any suitable processor capable of executing or otherwise performing instructions. A processor may include a central processing unit (CPU) that carries out program instructions to perform the arithmetical, logical, and input/output operations of computing system 1000. A processor may execute code (e.g., processor firmware, a protocol stack, a database management system, an operating system, or a combination thereof) that creates an execution environment for program instructions. A processor may include a programmable processor. A processor may include general or special purpose microprocessors. A processor may receive instructions and data from a memory (e.g., system memory 1020). Computing system 1000 may be a uni-processor system including one processor (e.g., processor 1010*a*), or a multi-processor system including any number of suitable processors (e.g., 1010*a*-1010*n*). Multiple processors may be employed to provide for parallel or sequential execution of one or more portions of the techniques described herein. Processes, such as logic flows, described herein may be performed by one or more programmable processors executing one or more computer programs to perform functions by operating on input data and generating corresponding output. Processes described herein may be performed by, and apparatus can also be implemented as, special purpose logic circuitry, e.g., an FPGA (field programmable gate array) or an ASIC (application specific integrated circuit). Computing system 1000 may include a plurality of computing devices (e.g., distributed computer systems) to implement various processing functions.

I/O device interface 1030 may provide an interface for connection of one or more I/O devices 1060 to computer system 1000. I/O devices may include devices that receive input (e.g., from a user) or output information (e.g., to a user). I/O devices 1060 may include, for example, graphical user interface presented on displays (e.g., a cathode ray tube (CRT) or liquid crystal display (LCD) monitor), pointing devices (e.g., a computer mouse or trackball), keyboards, keypads, touchpads, scanning devices, voice recognition devices, gesture recognition devices, printers, audio speakers, microphones, cameras, or other devices. I/O devices 1060 may be connected to computer system 1000 through a wired or wireless connection. I/O devices 1060 may be connected to computer system 1000 from a remote location. I/O devices 1060 located on a remote computer system, for example, may be connected to computer system 1000 via a network and network interface 1040.

Network interface 1040 may include a network adapter that provides for connection of computer system 1000 to a network. Network interface May 1040 may facilitate data exchange between computer system 1000 and other devices connected to the network. Network interface 1040 may support wired or wireless communication. The network may include an electronic communication network, such as the Internet, a local area network (LAN), a wide area network (WAN), a cellular communications network, or other networks.

System memory 1020 may be configured to store program instructions 1070 or data 1080. Program instructions 1070 may be executable by a processor (e.g., one or more of processors 1010*a*-1010*n*) to implement one or more embodiments of the present techniques. Instructions 1070 may include modules and/or components (e.g., machine readable instructions 15 and/or components 16-20 shown in FIG. 1) of computer program instructions for implementing one or more techniques described herein with regard to various processing modules and/or components. Program instructions may include a computer program (which in certain forms is known as a program, software, software application, script, or code). A computer program may be written in a programming language, including compiled or interpreted languages, or declarative or procedural languages. A computer program may include a unit suitable for use in a computing environment, including as a stand-alone program, a module, a component, or a subroutine. A computer program may or may not correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one or more computer processors located locally at one site or distributed across multiple remote sites and interconnected by a communication network.

System memory 1020 may include a tangible program carrier having program instructions stored thereon. A tangible program carrier may include a non-transitory computer readable storage medium. A non-transitory computer readable storage medium may include a machine readable storage device, a machine readable storage substrate, a memory device, or any combination thereof. Non-transitory computer readable storage medium may include non-volatile memory (e.g., flash memory, ROM, PROM, EPROM, EEPROM memory), volatile memory (e.g., random access memory (RAM), static random access memory (SRAM), synchronous dynamic RAM (SDRAM)), bulk storage memory (e.g., CD-ROM and/or DVD-ROM, hard-drives), or other memory. System memory 1020 may include a non-transitory computer readable storage medium that may have program instructions stored thereon that are executable by a computer processor (e.g., one or more of processors 1010*a*-1010*n*) to cause the subject matter and the functional operations described herein. A memory (e.g., system memory 1020) may include a single memory device and/or a plurality of memory devices (e.g., distributed memory devices). Instructions or other program code to provide the functionality described herein may be stored on a tangible, non-transitory computer readable media. In some cases, the entire set of instructions may be stored concurrently on the media, or in some cases, different parts of the instructions may be stored on the same media at different times, e.g., a copy may be created by writing program code to a first-in-first-out buffer in a network interface, where some of the instructions are pushed out of the buffer before other portions of the instructions are written to the buffer, with all of the instructions residing in memory on the buffer, just not all at the same time.

I/O interface 1050 may be configured to coordinate I/O traffic between processors 1010*a*-1010*n*, system memory 1020, network interface 1040, I/O devices 1060, and/or other peripheral devices. I/O interface 1050 may perform protocol, timing, or other data transformations to convert data signals from one component (e.g., system memory 1020) into a format suitable for use by another component (e.g., processors 1010*a*-1010*n*). I/O interface 1050 may include support for devices attached through various types of peripheral buses, such as a variant of the Peripheral Component Interconnect (PCI) bus standard or the Universal Serial Bus (USB) standard.

Embodiments of the techniques described herein may be implemented using a single instance of computer system 1000 or multiple computer systems 1000 configured to host different portions or instances of embodiments. Multiple computer systems 1000 may provide for parallel or sequential processing/execution of one or more portions of the techniques described herein.

Those skilled in the art will appreciate that computer system 1000 is merely illustrative and is not intended to limit the scope of the techniques described herein. Computer system 1000 may include any combination of devices or software that may perform or otherwise provide for the performance of the techniques described herein. For example, computer system 1000 may include or be a combination of a cloud-computing system, a data center, a server rack, a server, a virtual server, a desktop computer, a laptop computer, a tablet computer, a server device, a client device, a mobile telephone, a personal digital assistant (PDA), a mobile audio or video player, a game console, a vehicle-mounted computer, a television or device connected to a television (e.g., Apple TV™), or a Global Positioning System (GPS), or other devices. Computer system 1000 may also be connected to other devices that are not illustrated, or may operate as a stand-alone system. In addition, the functionality provided by the illustrated components may in some embodiments be combined in fewer components or distributed in additional components. Similarly, in some embodiments, the functionality of some of the illustrated components may not be provided or other additional functionality may be available.

Those skilled in the art will also appreciate that while various items are illustrated as being stored in memory or on storage while being used, these items or portions of them may be transferred between memory and other storage devices for purposes of memory management and data integrity. Alternatively, in other embodiments some or all of the software components may execute in memory on another device and communicate with the illustrated computer system via inter-computer communication. Some or all of the system components or data structures may also be stored (e.g., as instructions or structured data) on a computer-accessible medium or a portable article to be read by an appropriate drive, various examples of which are described above. In some embodiments, instructions stored on a computer-accessible medium separate from computer system 1000 may be transmitted to computer system 1000 via transmission media or signals such as electrical, electromagnetic, or digital signals, conveyed via a communication medium such as a network or a wireless link. Various embodiments may further include receiving, sending, or storing instructions or data implemented in accordance with the foregoing description upon a computer-accessible medium. Accordingly, the present invention may be practiced with other computer system configurations.

Figure 11:
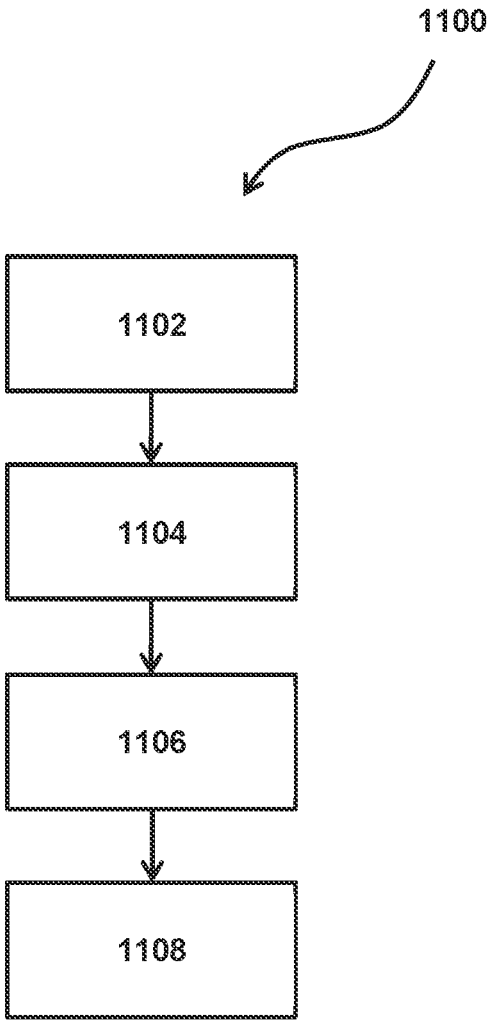
FIG. 11 illustrates a method for forming a metallic part, in accordance with one or more embodiments.

FIG. 11 illustrates a method 1100 for forming a metallic part. Method 1100 may be executed by a system such as system 10 (FIG. 1) and/or other systems. System 10 comprises one or more processors configured by machine-readable instructions, a forming tool, and/or other components. The one or more processors are configured to execute computer program components. The computer program components comprise a modelling component, a target location component, a control component, and/or other components. The operations of method 1100 presented below are intended to be illustrative. In some embodiments, method 1100 may be accomplished with one or more additional operations not described, and/or without one or more of the operations discussed. Additionally, the order in which the operations of method 1100 are illustrated in FIG. 11 and described below is not intended to be limiting.

In some embodiments, method 1100 may be implemented, at least in part, in one or more processing devices such as one or more processors 14 described herein (FIG. 1, e.g., a digital processor, an analog processor, a digital circuit designed to process information, an analog circuit designed to process information, a state machine, and/or other mechanisms for electronically processing information). The one or more processing devices may include one or more devices executing some or all of the operations of method 1100 in response to instructions (e.g., machine readable instructions 15) stored electronically on an electronic storage medium (e.g., data store 30). The one or more processing devices may include one or more devices configured through hardware, firmware, and/or software to be specifically designed for execution of one or more of the operations of method 1100.

At an operation 1102, residual stresses in a metallic part caused by forming may be electronically modelled. In some embodiments, the metallic part comprises a floor pan, battery tray, or a U model beam, for example. In some embodiments, the electronic modelling comprises predicting stresses in the metallic part caused by forming, using finite element analysis (FEA). This may include varying a location (or locations) of excess material in a model of the metallic part, and repeating the prediction of the stresses accordingly. In some embodiments, the predicted stresses comprise tensile stresses caused by material deformation, and compressive stresses in local areas of the metallic part induced by the excess material. In some embodiments, operation 1102 is performed by a processor component the same as or similar to modelling component 16 (shown in FIG. 1 and described herein).

At an operation 1104, one or more target locations in the metallic part for excess material are determined. The one or more target locations are determined based on the electronic modelling prior to forming, and/or other information. The excess material in the target locations is configured to decrease residual stress in the metallic part after forming. In some embodiments, the excess material comprises a bulging arcuate portion of the metallic part that would not normally have been provided for forming the metallic part. In some embodiments, the one or more target locations comprise a bend between a base and a sidewall of the metallic part. In some embodiments, operation 1104 is performed by a processor component the same as or similar to target location component 18 (shown in FIG. 1 and described herein).

At an operation 1106, the metallic part is contacted for forming. The metallic part is contacted for forming at one or more contact locations away from as-cut end surfaces of the metallic part, such that the as-cut end surfaces are unconstrained during forming. In some embodiments, contacting comprises holding and/or compressing the metallic part between two opposing surfaces of a die that span the bend from the base to the sidewall. In some embodiments, operation 1106 is performed by one or more contacts the same as or similar to contacts 23 of forming tool 22 (shown in FIG. 1 and described herein).

At an operation 1108, the excess material is caused to flow during forming. The excess material is caused to flow in one or more specific directions during forming to decrease the residual stress in the metallic part and reduce springback behavior in the metallic part after forming. In some embodiments, causing the excess material to flow in one or more specific directions during forming produces: (1) a pattern of plastic compression in the sidewall, elastic compression in the bend, and plastic tension in the base, on an outside radius of the bend; and (2) a corresponding pattern of plastic tension in the sidewall, elastic tension in the bend, and plastic compression in the base, on an inside radius of the bend. This decreases the residual stress in the metallic part and reduces springback behavior in the metallic part after forming. In some embodiments, causing the excess material to flow in one or more specific directions during forming produces balanced opposite bending moments on either side of the bend to decrease the residual stress in the metallic part and reduces springback behavior in the metallic part after forming. In some embodiments, operation 1108 comprises pre-forming the metallic part so it includes the excess material at the one or more target locations, and then forming the metallic part as described above. In some embodiments, operation 1108 is performed by a processor component the same as or similar to control component 20 and/or dies 24 of forming tool 22 (shown in FIG. 1 and described herein).

In block diagrams, illustrated components are depicted as discrete functional blocks, but embodiments are not limited to systems in which the functionality described herein is organized as illustrated. The functionality provided by each of the components may be provided by software or hardware modules that are differently organized than is presently depicted, for example such software or hardware may be intermingled, conjoined, replicated, broken up, distributed (e.g. within a data center or geographically), or otherwise differently organized. The functionality described herein may be provided by one or more processors of one or more computers executing code stored on a tangible, non-transitory, machine readable medium. In some cases, notwithstanding use of the singular term "medium," the instructions may be distributed on different storage devices associated with different computing devices, for instance, with each computing device having a different subset of the instructions, an implementation consistent with usage of the singular term "medium" herein. In some cases, third party content delivery networks may host some or all of the information conveyed over networks, in which case, to the extent information (e.g., content) is said to be supplied or otherwise provided, the information may be provided by sending instructions to retrieve that information from a content delivery network.

The reader should appreciate that the present application describes several inventions. Rather than separating those inventions into multiple isolated patent applications, applicants have grouped these inventions into a single document because their related subject matter lends itself to economies in the application process. But the distinct advantages and aspects of such inventions should not be conflated. In some cases, embodiments address all of the deficiencies noted herein, but it should be understood that the inventions are independently useful, and some embodiments address only a subset of such problems or offer other, unmentioned benefits that will be apparent to those of skill in the art reviewing the present disclosure. Due to cost constraints, some inventions disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such inventions or all aspects of such inventions.

It should be understood that the description and the drawings are not intended to limit the invention to the particular form disclosed, but to the contrary, the intention is to cover all modifications, equivalents, and alternatives falling within the spirit and scope of the present invention as defined by the appended claims. Further modifications and alternative embodiments of various aspects of the invention will be apparent to those skilled in the art in view of this description. Accordingly, this description and the drawings are to be construed as illustrative only and are for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed or omitted, and certain features of the invention may be utilized independently, all as would be apparent to one skilled in the art after having the benefit of this description of the invention. Changes may be made in the elements described herein without departing from the spirit and scope of the invention as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and other terms, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X'ed items," used for purposes of making claims more readable rather than specifying sequence. Statements referring to "at least Z of A, B, and C," and other similar statements (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or similar terms refer to actions or processes of a specific apparatus, such as a special purpose computer or a similar special purpose electronic processing/computing device.

Although the disclosure has been described in detail for the purpose of illustration based on what is currently considered to be the most practical and preferred embodiments, it is to be understood that such detail is solely for that purpose and that the disclosure is not limited to the disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

Various embodiments are disclosed in the subsequent list of numbered clauses:

1. A method for forming a metallic part, the method comprising: determining, based on electronic modelling prior to forming, one or more target locations in the metallic part for excess material, the excess material in the target locations configured to decrease residual stress in the metallic part after forming; contacting the metallic part for forming at one or more contact locations away from as-cut end surfaces of the metallic part, such that the as-cut end surfaces are unconstrained during forming; and causing, based on the one or more contact locations and the excess material at the one or more target locations, the excess material to flow in one or more specific directions during forming to decrease the residual stress in the metallic part and reduce springback behavior in the metallic part after forming.
2. The method of clause 1, wherein the excess material comprises a bulging arcuate portion of the metallic part that would not normally have been provided for forming the metallic part.
3. The method of any of the previous clauses, wherein the excess material comprises excess length of line in the metallic part that would not normally have been provided for forming the metallic part.
4. The method of any of the previous clauses, wherein the one or more target locations comprise a bend between a base and a sidewall of the metallic part.
5. The method of any of the previous clauses, wherein causing the excess material to flow in one or more specific directions during forming produces: (1) a pattern of plastic compression in the sidewall, elastic compression in the bend, and plastic tension in the base, on an outside radius of the bend; and (2) a corresponding pattern of plastic tension in the sidewall, elastic tension in the bend, and plastic compression in the base, on an inside radius of the bend; to decrease the residual stress in the metallic part and reduce springback behavior in the metallic part after forming.
6. The method of any of the previous clauses, wherein causing the excess material to flow in one or more specific directions during forming produces balanced opposite bending moments on either side of the bend to decrease the residual stress in the metallic part and reduces springback behavior in the metallic part after forming.
7. The method of any of the previous clauses, further comprising pre-forming the metallic part so it includes the excess material at the one or more target locations.
8. The method of any of the previous clauses, wherein the metallic part comprises a floor pan, battery tray, or a U model beam.

9. The method of any of the previous clauses, wherein the electronic modelling comprises predicting stresses in the metallic part caused by forming, using finite element analysis (FEA).
10. The method of any of the previous clauses, wherein the predicted stresses comprise tensile stresses caused by material deformation, and compressive stresses in local areas of the metallic part induced by the excess material.
11. The method of any of the previous clauses, wherein the one or more target locations comprise a bend between a base and a sidewall of the metallic part, and wherein contacting comprises holding and/or compressing the metallic part between two opposing surfaces of a die that span the bend from the base to the sidewall.
12. A system for forming a metallic part, the system comprising: one or more hardware processors configured to determine, based on electronic modelling prior to forming, one or more target locations in the metallic part for excess material, the excess material in the target locations configured to decrease residual stress in the metallic part after forming; and a forming tool comprising: one or more contacts configured to contact the metallic part for forming at one or more contact locations away from as-cut end surfaces of the metallic part, such that the as-cut end surfaces are unconstrained during forming; and one or more dies configured to cause, based on the one or more contact locations and the excess material at the one or more target locations, the excess material to flow in one or more specific directions during forming to decrease the residual stress in the metallic part and reduce springback behavior in the metallic part after forming.
13. The system of clause 12, wherein the excess material comprises a bulging arcuate portion of the metallic part that would not normally have been provided for forming the metallic part.
14. The system of any of the previous clauses, wherein the excess material comprises excess length of line in the metallic part that would not normally have been provided for forming the metallic part.
15. The system of any of the previous clauses, wherein the one or more target locations comprise a bend between a base and a sidewall of the metallic part.
16. The system of any of the previous clauses, wherein causing the excess material to flow in one or more specific directions during forming produces: (1) a pattern of plastic compression in the sidewall, elastic compression in the bend, and plastic tension in the base, on an outside radius of the bend; and (2) a corresponding pattern of plastic tension in the sidewall, elastic tension in the bend, and plastic compression in the base, on an inside radius of the bend; to decrease the residual stress in the metallic part and reduce springback behavior in the metallic part after forming.
17. The system of any of the previous clauses, wherein causing the excess material to flow in one or more specific directions during forming produces balanced opposite bending moments on either side of the bend to decrease the residual stress in the metallic part and reduces springback behavior in the metallic part after forming.
18. The system of any of the previous clauses, wherein the one or more dies are further configured to, before forming, pre-form the metallic part so it includes the excess material at the one or more target locations.
19. The system of any of the previous clauses, wherein the metallic part comprises a floor pan, battery tray, or a U model beam.
20. The system of any of the previous clauses, wherein the electronic modelling comprises predicting stresses in the metallic part caused by forming, using finite element analysis (FEA).
21. The system of any of the previous clauses, wherein the predicted stresses comprise tensile stresses caused by material deformation, and compressive stresses in local areas of the metallic part induced by the excess material.
22. The system of any of the previous clauses, wherein the one or more target locations comprise a bend between a base and a sidewall of the metallic part, and wherein contacting comprises holding and/or compressing the metallic part between two opposing surfaces of a die that span the bend from the base to the sidewall.

What is claimed is:

1. A method for forming a metallic part, the method comprising:

determining, based on electronic modelling prior to the forming, one or more target locations in the metallic part for excess material, the excess material in the one or more target locations configured to decrease residual stress in the metallic part after the forming;

pre-forming the metallic part so the metallic part includes the excess material at the one or more target locations;

contacting the metallic part for the forming at one or more contact locations away from as-cut end surfaces of the metallic part, such that the as-cut end surfaces are unconstrained during the forming; and causing, based on the one or more contact locations and the excess material at the one or more target locations, the excess material to flow in one or more specific directions during the forming to decrease the residual stress in the metallic part and reduce springback behavior in the metallic part after the forming.

2. The method of claim 1, wherein the excess material comprises a bulging arcuate portion of the metallic part.

3. The method of claim 1, wherein the excess material comprises excess length of line in the metallic part.

4. The method of claim 1, wherein the one or more target locations comprise a bend between a base and a sidewall of the metallic part.

5. The method of claim 4, wherein causing the excess material to flow in one or more specific directions during the forming produces:

(1) a pattern of plastic compression in the sidewall, elastic compression in the bend, and plastic tension in the base, on an outside radius of the bend; and (2) a corresponding pattern of plastic tension in the sidewall, elastic tension in the bend, and plastic compression in the base, on an inside radius of the bend;

to decrease the residual stress in the metallic part and reduce the springback behavior in the metallic part after the forming.

6. The method of claim 4, wherein causing the excess material to flow in one or more specific directions during the forming produces balanced opposite bending moments on either side of the bend to decrease the residual stress in the metallic part and reduces the springback behavior in the metallic part after the forming.

7. The method of claim 1, wherein the metallic part comprises floor pan, a battery tray, or a U model beam.

8. The method of claim 1, wherein the electronic modelling comprises predicting stresses in the metallic part caused by the forming, using finite element analysis (FEA).

9. The method of claim 8, wherein the predicted stresses comprise tensile stresses caused by material deformation, and compressive stresses in local areas of the metallic part induced by the excess material.

10. The method of claim 1, wherein the one or more target locations comprise a bend between a base and a sidewall of the metallic part, and wherein contacting comprises holding and/or compressing the metallic part between two opposing surfaces of a die that span the bend from the base to the sidewall.

11. A system for forming a metallic part, the system comprising:

one or more hardware processors configured to determine, based on electronic modelling prior to the forming, one or more target locations in the metallic part for excess material, the excess material in the one or more target locations configured to decrease residual stress in the metallic part after the forming; and a forming tool comprising:

one or more contacts configured to contact the metallic part for the forming at one or more contact locations away from as-cut end surfaces of the metallic part, such that the as-cut end surfaces are unconstrained during the forming; and one or more dies configured to cause, based on the one or more contact locations and the excess material at the one or more target locations, the excess material to flow in one or more specific directions during the forming to decrease the residual stress in the metallic part and reduce springback behavior in the metallic part after the forming;

wherein the one or more dies are further configured to, before the forming, pre-form the metallic part so the metallic part includes the excess material at the one or more target locations.

12. The system of claim 11, wherein the excess material comprises a bulging arcuate portion of the metallic part.

13. The system of claim 11, wherein the excess material comprises excess length of line in the metallic part.

14. The system of claim 11, wherein the one or more target locations comprise a bend between a base and a sidewall of the metallic part.

15. The system of claim 14, wherein causing the excess material to flow in one or more specific directions during the forming produces:

(1) a pattern of plastic compression in the sidewall, elastic compression in the bend, and plastic tension in the base, on an outside radius of the bend; and (2) a corresponding pattern of plastic tension in the sidewall, elastic tension in the bend, and plastic compression in the base, on an inside radius of the bend;

to decrease the residual stress in the metallic part and reduce the springback behavior in the metallic part after the forming.

16. The system of claim 14, wherein causing the excess material to flow in one or more specific directions during the forming produces balanced opposite bending moments on either side of the bend to decrease the residual stress in the metallic part and reduces the springback behavior in the metallic part after the forming.

17. The system of claim 11, wherein the metallic part comprises a floor pan, battery tray, or a U model beam.

18. The system of claim 11, wherein the electronic modelling comprises predicting stresses in the metallic part caused by the forming, using finite element analysis (FEA).

19. The system of claim 18, wherein the predicted stresses comprise tensile stresses caused by material deformation, and compressive stresses in local areas of the metallic part induced by the excess material.

20. The system of claim 11, wherein the one or more target locations comprise a bend between a base and a sidewall of the metallic part, and wherein contacting comprises holding and/or compressing the metallic part between two opposing surfaces of a die that span the bend from the base to the sidewall.

* * * * *